United States Patent [19]

Matsuda et al.

[11] 4,015,450

[45] Apr. 5, 1977

[54] CONCEALED SLIDE FASTENERS

[75] Inventors: Yoshio Matsuda, Nyuzen; Yoshitoki Tsubokawa, Kurobe, both of Japan

[73] Assignee: Yoshida Kogyo Kabushiki Kaisha, Japan

[22] Filed: Sept. 10, 1975

[21] Appl. No.: 611,896

[30] Foreign Application Priority Data

Sept. 25, 1974 Japan ..... 49-116206[U]

[52] U.S. Cl. ..... 66/195; 24/205.1 C

[51] Int. Cl.[2] ..... D04B 21/00

[58] Field of Search ..... 66/195, 190, 192; 24/205.1 C, 13 C, 16 C

[56] References Cited

UNITED STATES PATENTS

| | | | |
|---|---|---|---|
| 3,685,474 | 8/1972 | Frolich | 66/195 X |
| 3,820,202 | 6/1974 | Takamatsu | 24/205.1 C |
| 3,874,036 | 4/1975 | Yoshikawa | 24/205.1 C |

*Primary Examiner*—Ronald Feldbaum
*Attorney, Agent, or Firm*—Bucknam and Archer

[57] ABSTRACT

A slide fastener of the concealed or masked type comprises a pair of opposed support tapes each having a longitudinal edge portion folded on itself and rows of interlocking fastener elements secured to the folded edge portions of the respective support tapes. The tape is made of a warp-knit fabric having on one surface a multiplicity of alternate wales and interwale grooves. A particular wale disposed close to the path of a sewing needle is formed with fewer knit threads than the remaining portions of the tape to reduce the loop density thereat and hence renders this wale portion flexible to permit the tape to yield itself to the sewing pressure.

2 Claims, 3 Drawing Figures

CONCEALED SLIDE FASTENERS

BACKGROUND OF THE INVENTION

This invention relates to slide fasteners, more paticularly to a slider-operated fastener of the concealed or masked type which in its closed disposition substantially simulates a garment seam.

Slide fasteners are well known which comprise a pair of rows of interlocking fastener elements formed from a continuous filament or wire and secured to respective folded edges of opposed stringer tapes, and such fasteners when closed by the slider mask the elements from external view, only leaving a linear seam in the junction of the opposed tapes.

In such known concealed or masked type of fastener, there were used support tapes of a warp-knit structure, as contrasted to conventional woven fabric tapes, for supporting thereon respective rows of fastener elements. The warp-knit tape inherently has a multiplicity of wales and interwale grooves on one or the other or both of its surfaces, which wales and interwale grooves can be conveniently utilized for securing the fastener element firmly to the tape for example by engaging the wales with recesses formed in the elements. While fasteners including stringers of the character described are advantageous from the point of view of attaching the fastener elements securely to the respective support tapes, they have presented a difficulty in sewing the fastener properly into position on a garment fabric or other articles. This difficulty arose from the fact that the portion of the support tape at and along which the fastener was to be sewn to the garment was structurally identical to and as hard and heavy as the remaining portions of the tape, with the wales at the first-mentioned tape portion often interferring with or obstructing the normal thrusting action of the sewing needle.

SUMMARY OF THE INVENTION

With the foregoing drawback of the prior art slide fasteners in view, it is an object of the present invention to provide an improved slide fastener of the concealed type having warp-knitted support tapes which will enable a sewing needle to pass through a correct line of stitching extending closely along a folded longitudinal edge of each support tape, so that the fastener can be sewn properly into position on a garment or other articles.

Briefly stated, the above object can be achieved by the provision of a concealed type of slide fastener comprising a pair of warp-knit support tapes each having a longitudinal element-carrying edge inwardly folded on itself, rows of fastener elements secured to respective element carrying edges, each of said fastener elements having leg portions, a coupling head portion merging into said leg portions and connecting portions remote from said coupling head and connecting the element of respective adjacent elements, and said support tapes having on one surface a multiplicity of longitudinally extending alternated wales and interwale grooves, the improvement being that the number of knitting threads forming the wales is reduced at the wale region of each support tape which is located adjacent the path of a sewing needle as compared to the number of knitting threads at the remaining regions of the tape, whereby each support tape can be sewn onto a garment fabric in a manner that the sewing needle provides a sewn seam at and along the inwardly folded edge of the tape.

This invention will be better understood from the following detailed description taken in conjunction with the accompanying drawing illustrating a preferred embodiment which the invention may assume in practice.

DETAILED DESCRIPTION OF THE PREFERRED EMBODIMENT

Figure 1:
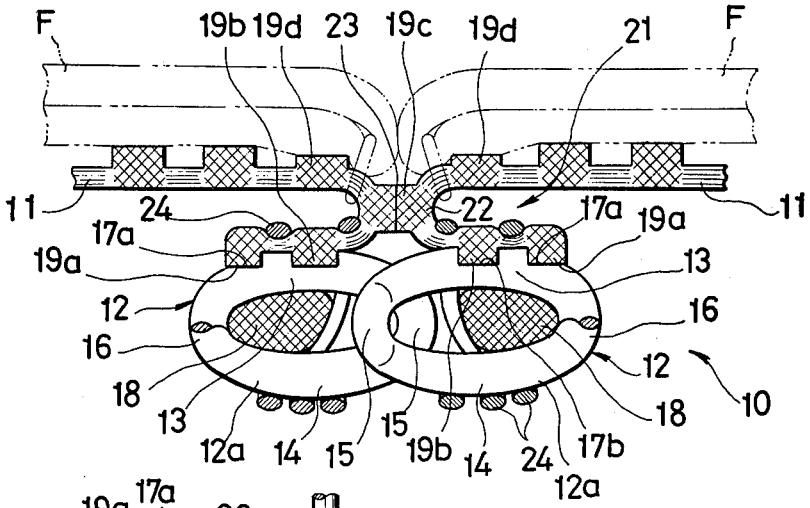
FIG. 1 is a transverse cross-sectional view of a concealed type of slide fastener provided in accordance with the invention.

Referring now to the drawing and FIG. 1 in particular, there is shown a slide fastener 10 which essentially comprises a pair of oppositely disposed stringers or support tapes 11 and a row of fastener elements 12 secured to each support tape, which fastener elements are shown for purposes of illustration to be in the form of a continuous, helically coiled structure. This structure when taken as an individual convolution **12*a* comprises an upper leg portion 13, a lower leg portion 14, a coupling head 15 merging into these leg portions and connecting portions 16 remote from the coupling head 15 and connecting the convolution 12*a* to respective adjacent convolutions. One of the two leg portions 13, 14 is provided at its outer surface with cutaway recesses 17*a* 17*b* for purposes hereafter described. There is provided a longitudinally extending filler cord 18 which is inserted in and through the space defined between the upper and lower legs 13 and 14 of the fastener element 12. The support tape 11 is made of a warp-knitted fabric having on one surface a multiplicity of alternate wales 19 and interwale grooves 20, with the other surface rendered flat as shown. The tape 11 has an element-carrying edge 21 inwardly folded on itself about a fold 22 and adapted for mounting thereon the row of fastener elements 12, the arrangement being that when the two opposed rows of fastener elements are taken into coupling engagement with each other, the folded edges of the respective support tapes 11 are brought closely together to form a junction 23 which conceals or masks the elements 12** from external view, as shown in FIG. 1.

Figure 3:
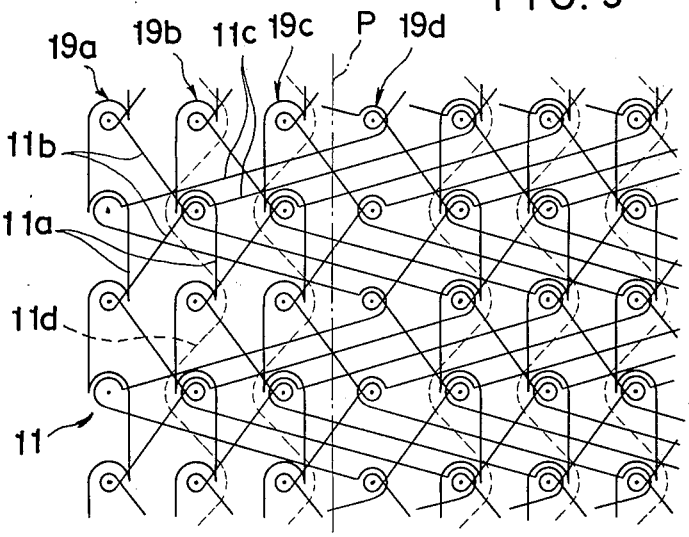
FIG. 3 is a diagram schematically illustrating a preferred knit pattern employed for the purpose of the invention.

A preferred warp-knit structure for the support tape 11 according to the invention is diagrammatically shown in FIG. 3 and comprises chain stitches **11*a*, tricot stitches 11*b* in the lay 1-2/1-0 stitches 11*c* in the lay 0-1/4-and reinforcing warp threads 11*d*. According to an important feature of the invention, the number of knitting threads or yarns which form the wales is reduced at the region of the support tape 11 which is located adjacent the path P of sewing needle N as compared to the number of knitting threads or yarns arranged at the remaining regions of the tape 11. In the illustrated embodiment, the region of the tape 11 adjoining the path P of sewing needle N corresponds in position to an interwale groove 20*a* between the third wale 19*c* and the fourth wale 19*d* counting from the innermost or first wale 19*a*. It is to be noted that the fourth wale 19*d* is constituted only by 1-2/1-0 tricot stitches 11*b* and 0-1/4-3 stitches 11*c*, with chain stitches 11***a* and reinforcing warp threads 11*d* removed from this region of the tape 11, so that the loop density of the fourth wale 19*d* is reduced to an extent to make this portion of the tape highly flexible.

Figure 2:
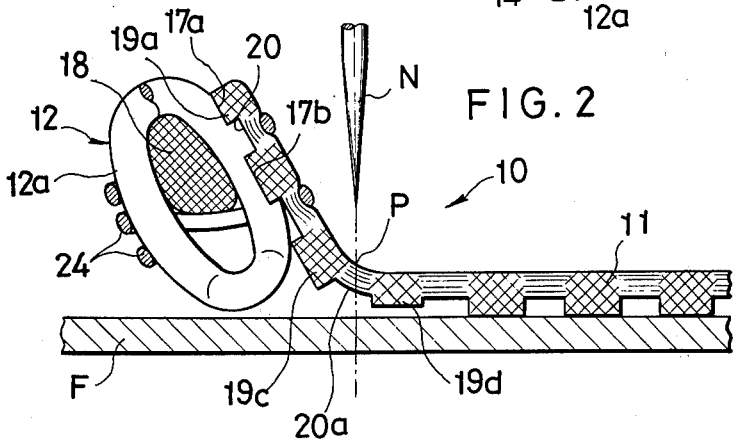
FIG. 2 is a transverse cross-sectional view of one of the pair of stringers of the fastener of FIG. 1 disposed for sewing onto a garment fabric.

According to the illustrated embodiment, the rows of fastener elements 12 are secured by sewn stitches 24 to the element-carrying edges 21 of respective support tapes 11 with the first wale 19*a* anchored in place respectively at the recesses 17*a* and 17*b* of the elements 12. When attaching the fastener 10 to a garment fabric F, the former is laid over the latter with the waled side of the support tape 11 faced down as seen in FIG. 2. The sewing needle N is operated to thrust through the third interwale groove 20*a* adjoining the fourth wale 19*d*, when this wale being flexible can yield itself to the sewing pressure without restricting the thrusting action of the needle N. Flexibility of the fourth wale 19*d* further ensures that should the needle N sway slightly out of line during the course of its sewing operation, it can still continue to sew the tape 11 substantially along the path P within the interwale groove 20*a* so as to provide a sewn seam on the garment fabric F where desired above the folded edge of each tape to maintain the effect of concealing the fastener elements from external view. A further advantage of the fourth wale 19*d* being pliable or flexible as compared to the remaining wales of the tape is that the respective support tapes 11 can be easily folded as desired into the position of FIG. 1 in which the third wales 19*c* of the opposed tapes are brought together into abutting engagement as the rows of fastener elements 12 are taken into coupling engagement by the action of a slider not shown.

What is claimed is:

1. In a concealed type of slide fastener having a pair of warp-knit support tapes each having a longitudinal element-carrying edge portion inwardly folded toward the remaining portion of the tape, rows of fastener elements, each row secured to a respective element-carrying edge portion; each of said fastener elements having leg portions, a coupling head portion merging into said leg portions and connecting portions remote from said coupling head portion and connecting the element to respective adjacent elements, said support tapes having knitted threads forming a warp-knit structure defining on one surface of each support tape a multiplicity of longitudinally extending alternated wales and interwale grooves, the improvement in which the number of knitting threads forming the wales is reduced at the wale region of each support tape which is located adjacent the path of a sewing needle as compared to the number of knitting threads at the remaining regions of the tape, whereby each support tape can be sewn onto a garment fabric in a manner that the sewing needle provides a sewn seam at and along the inwardly folded edge of the tape, the wale region adjacent the path of said sewing needle consisting of tricot stitches in the lay 1-2/1-0 and stitches in the lay 0-1/4-3 while the remaining regions of the support tape consist of chain stitches, tricot stitches in the lay 1-2/1-0 stitches in the lay 0-1/4-3 and reinforcing warp threads.

2. The improvement as defined in claim 1 wherein one of the leg portions is provided on its outer surface with recesses adapted to anchor therein the wales extending along the folded element-carrying edge of each support tape.

* * * * *